US008615822B2

(12) United States Patent
Vargas et al.

(10) Patent No.: US 8,615,822 B2
(45) Date of Patent: Dec. 31, 2013

(54) AIR PRESSURE ACTIVATED TOILET FLUSHING SYSTEM

(75) Inventors: Matt Vargas, San Jose, CA (US); Brian Lamb, Belmont, CA (US); Tom Stout, San Jose, CA (US); Eric Bennett, San Francisco, CA (US); Tuan Le, Diamond Bar, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 494 days.

(21) Appl. No.: 12/652,586

(22) Filed: Jan. 5, 2010

(65) Prior Publication Data

US 2010/0299822 A1 Dec. 2, 2010

Related U.S. Application Data

(60) Provisional application No. 61/182,742, filed on May 31, 2009.

(51) Int. Cl.
*E03D 1/24* (2006.01)

(52) U.S. Cl.
USPC ..... 4/329; 4/324; 4/362

(58) Field of Classification Search
USPC ..... 4/353–419, 328, 332, 334, 431–433
See application file for complete search history.

(56) References Cited

U.S. PATENT DOCUMENTS

| | | | | |
|---|---|---|---|---|
| 2,282,604 | A | | 5/1942 | Ingraham |
| 3,546,714 | A | | 12/1970 | Middleton |
| 3,605,125 | A | | 9/1971 | Gibbs |
| 4,142,262 | A | | 3/1979 | Hamilton |
| 4,233,698 | A | | 11/1980 | Martin |
| 4,286,342 | A | | 9/1981 | Anthony |
| 4,561,132 | A | * | 12/1985 | Lew et al. ..... 4/420 |
| 4,989,277 | A | | 2/1991 | Tsutsui et al. |
| 5,052,060 | A | | 10/1991 | Makita et al. |
| 5,136,732 | A | | 8/1992 | Andersson |
| 5,210,884 | A | | 5/1993 | Redford |
| 5,241,711 | A | | 9/1993 | Badders |
| 5,305,475 | A | | 4/1994 | Jaeckels et al. |
| 5,361,426 | A | | 11/1994 | Martin |
| 5,388,282 | A | | 2/1995 | Cherry |
| 5,435,019 | A | | 7/1995 | Badders |
| 5,469,586 | A | | 11/1995 | Tsutsui et al. |
| 5,502,845 | A | | 4/1996 | Hayashi et al. |
| 6,115,853 | A | | 9/2000 | Shibata et al. |
| 6,401,270 | B1 | | 6/2002 | Moore |
| 6,457,187 | B1 | | 10/2002 | Andersson et al. |
| 6,470,505 | B1 | | 10/2002 | Boisvert |
| RE37,921 | E | | 12/2002 | Martin et al. |
| 6,795,982 | B2 | | 9/2004 | Noboru et al. |
| 6,977,005 | B2 | | 12/2005 | Erdmann et al. |
| 6,986,172 | B2 | | 1/2006 | Hidetaka et al. |
| 7,010,816 | B2 | | 3/2006 | Li |
| 7,272,864 | B2 | | 9/2007 | Grob et al. |
| 2009/0313750 | A1 | * | 12/2009 | Okubo et al. ..... 4/354 |

* cited by examiner

OTHER PUBLICATIONS

PCT International Search Report and Written Opinion, Jan. 16, 2010.

*Primary Examiner* — Gregory Huson
*Assistant Examiner* — Janie Christiansen
(74) *Attorney, Agent, or Firm* — Gordon & Rees LLP

(57) ABSTRACT

An air activated toilet flush system, including: a toilet bowl; a reservoir; a fluid conduit between the reservoir and the toilet bowl; a system for supplying water into the reservoir; and a system for supplying air into the reservoir, wherein a supply of air into the reservoir causes fluid to flow from the reservoir through the fluid conduit and into the toilet bowl.

24 Claims, 5 Drawing Sheets

AIR PRESSURE ACTIVATED TOILET FLUSHING SYSTEM

CROSS-REFERENCE TO RELATED APPLICATIONS

The present application claims priority to provisional patent application Ser. No. 61/182,742 filed May 31, 2009, entitled "Tankless Flush Systems for Toilets," which is incorporated by reference into the instant application as if set forth verbatim.

TECHNICAL FIELD

The present invention relates to toilets that flush without requiring an elevated water tank positioned above the toilet bowl, or a flapper flush valve positioned between an elevated water tank and the toilet bowl.

BACKGROUND OF THE INVENTION

Most conventional residential toilets make use of an elevated supply of water in a tank mounted above the toilet bowl. To flush the toilet, the user actuates a lever or button which releases the elevated water into the toilet bowl under the force of gravity. However, such elevated toilet tanks are bulky and unattractive, and are prone to leak risks. Therefore, a need exists for a toilet that flushes without requiring an elevated tank, and which is also suitable for both residential and commercial use.

Additionally, in recent years water conservation has become more important to many people and municipalities. In fact, many jurisdictions have laws limiting the amount of water that can be used per toilet flush. Also in response to the need for water conservation, dual flush toilets have been developed. In a dual flush toilet, there are two user-selectable flush sizes. A small flush is used to dispose of liquid waste. A large flush is used to dispose of solid waste. Preferably, the desired toilet would also be suitable for use with dual flush technologies. Importantly, water conservation includes both changing flush sizes and prevention of leak failures. Therefore, it is also desirable to provide a "flapperless" toilet since toilet flappers are prone to wear out and are also sensitive to harsh chemicals and grey water. As such, the elimination of the flapper valve is very desirable to reduce both the service expense and inconvenience of this messy and time-consuming replacement.

SUMMARY OF THE INVENTION

The present invention provides a toilet flushing system that requires no elevated water tank positioned above and behind the toilet bowl as seen in conventional gravity powered toilets. However, the present flush system offers many additional benefits and can optionally be used to replace a conventional flush system in a regular toilet as well.

In a preferred embodiment, the present invention provides an air pressure activated toilet flush system, comprising: a toilet bowl; a reservoir; a fluid conduit between the reservoir and the toilet bowl; a system for supplying water into the reservoir; and a system for supplying air into the reservoir, wherein a supply of air into the reservoir causes an increase in pressure, causing the fluid to flow from the reservoir through the fluid conduit and into the toilet bowl.

In various preferred embodiments, the system for supplying air into the reservoir supplies ambient air into the reservoir. In addition, the reservoir preferably has an open air communication path to the ambient air through the air supply system (e.g.: blower) when the system for supplying air is turned off. Thus (when turned on) the air supply system closes or otherwise overcomes this ambient connection, and directs air into the reservoir. This has the advantage of preventing a vacuum from forming in the reservoir if the toilet is clogged. In contrast (when turned off) there is an unblocked free flow of air between the reservoir and the ambient air.

In operation, the reservoir contains air and water, and the supply of air into the reservoir overcomes the open air path to the ambient air and causes air pressure in the reservoir to increase, thereby forcing the water out of the reservoir through the fluid conduit and into the toilet bowl. Preferably, the system for supplying air into the reservoir has an air outlet into the reservoir that is positioned above an inlet of the fluid conduit leading from the reservoir into the toilet bowl. The fluid conduit may optionally comprise a tube having a downward spillway into the toilet bowl. In various embodiments, the fluid conduit may also have a mid-section positioned higher than the rim of the toilet bowl.

In another preferred embodiment, the present system includes a toilet bowl with a reservoir tank feeding water into the toilet bowl. The tank includes a water reservoir containing a predetermined volume of water and a riser conduit having an upper end above the surface of the predetermined volume of water and a lower end extending below the surface of the predetermined volume of water. A spillway provides a path for fluid flow between the upper end of the riser conduit and the toilet bowl. An air inlet conduit is provided with an outlet inside the water reservoir above the surface of the predetermined volume of water. The air inlet conduit is connected to a source of pressurized air. A flush actuator is associated with the source of pressurized air so that when the flush actuator is activated, pressurized air flows through the outlet of the air inlet conduit into the water reservoir above the surface of the predetermined volume of water, thereby pressurizing the water reservoir and forcing at least a portion of the predetermined volume of water up the riser conduit, through the spillway and into the toilet bowl.

In yet another aspect of the invention, an air activated toilet flush system is provided, comprising: a toilet bowl; a reservoir; a fluid conduit between the reservoir and the toilet bowl; a system for supplying water into the reservoir; and a system for supplying air directly into the toilet bowl, wherein a supply of air into the toilet bowl builds up pressure and pushes the waste out of the bowl. This can be accomplished in a number of different ways. First, air can enter a manifold to build up pressure and push the waste out of the bowl. Then, the air can be diverted by the manifold to blow into the reservoir to force the fluid to flow from the reservoir through the fluid conduit and into the toilet bowl. Second, the manifold can create channels for pressure to be applied to both the reservoir and bowl simultaneously. Due to geometry considerations, the pressurized air provides water to the bowl while the air is moving the bowl contents, allowing the fill mechanism to function as it normally does to refill the tank. Third, the manifold may route the incoming fluid directly to the bowl, bypassing the reservoir. In this third embodiment, the dispensed fluid amount is either controlled by a timer, or a sensor system in the bowl. In these optional aspects of the invention, the toilet bowl comprises an air-tight sealable lid, and air pressure may be directed into the bowl itself to induce the flushing action.

A first advantage of the present invention is that it avoids the flexible flapper valve that commonly separates an elevated toilet water tank from the toilet bowl below. Flexible flapper vales are typically the weakest part of a toilet system and are therefore the most prone to malfunction (causing water to leak from the toilet tank down into the toilet bowl). As a result, the flapper valve is typically the first part of the toilet system to be replaced.

Other advantages of the present system include the fact that it conserves water in several different ways. First, tank-to-bowl water leakage is completely avoided (as there is no elevated tank sitting above the bowl and thus no flapper valve separation of the tank and bowl). Second, the present system is designed to use only the amount of water that is actually desired for the flush. In the present system, a specified duration of air flow is used to control the fluid volume of the flush. Other embodiments may optionally instead include sensor systems to measure water volumes. Since the duration of air flow can be pre-set to various intermediate levels as desired, the precise water volume of the flush can also be pre-set. As a result, it is not necessary to use a standard size "tank" of water for the flush. Rather, in accordance with the present invention, an option of selecting a sliding-scale of flush volumes can be provided. This is in contrast to existing dual flush toilets in which the user either selects a "half" or a "full" flush.

Third, by using air flow to cause the water flush, the timing of the flush rate can be set to precise desired profiles. For example, it may be preferable to use a flush with a constant rate of flow volume from start to finish. However, it may instead be preferable to use a flush with a rate of flow that decreases (or increases) over time. With the present system, the exact rate of water flow may be increased and decreased to different levels at different times during the flush, as desired. Consequently, many flush profiles are possible. For example, it is possible to design a flush profile that initially starts at a high fluid level, decreases for a period of time, and then increases again towards the end of the flush. As can be appreciated, with the present system, it is easy to design flush "profiles" that have different flush volumes and flush fluid flow rates that change over time. This feature can result in water savings since flush profiles can be designed to be optimal for the particular geometry of the particular toilet bowl used. Or they can be optimized for other needs like noise, type of user effluent, cleaning, etc. Fourth, by using effective flush profiles, the present water tank can be smaller than found in commonly used standard toilets.

Moreover, different buildings commonly have very different main line water pressures. This has often proven difficult when designing or installing conventional toilets. Yet another advantage of the present system, however, is that it is not affected by such differences in water pressure found among various buildings and households. This is because the present system advantageously operates by air pressures activating the flush; and not by water pressures activating the flush.

The present toilet system is easy to install, maintain and operate, and can be used with different bowl sizes and geometries. The present system has few moving fluid parts than conventional elevated tank toilets and is thus better adapted to harsh water conditions due to chemicals or even grey water reuse. Lastly, other advantages of the present invention are that it provides a very consistent flush; and it is durable and long lasting.

Other advantages include, but are not limited to, the system being under ambient pressure when not in operation. Also, it is easy to change system flow rates easily without having to change flush valve sizes (which allows the user to adjust the flush volume without even contacting the water in the tank).

DETAILED DESCRIPTION OF THE DRAWINGS

Exemplary embodiments of the inventions are described below. The figures are not necessarily drawn to scale and do not necessarily show every detail or structure of the various embodiments of the inventions, but rather illustrate exemplary embodiments and mechanical features in order to provide an enabling description of such embodiments.

In various aspects of the invention, an air activated toilet flush system is provided, comprising: a toilet bowl; a reservoir; a fluid conduit between the reservoir and the toilet bowl; a system for supplying water into the reservoir; and a system for supplying air into the reservoir, wherein an injection of air into the reservoir causes fluid to flow from the reservoir through the fluid conduit and into the toilet bowl.

Figure 1:
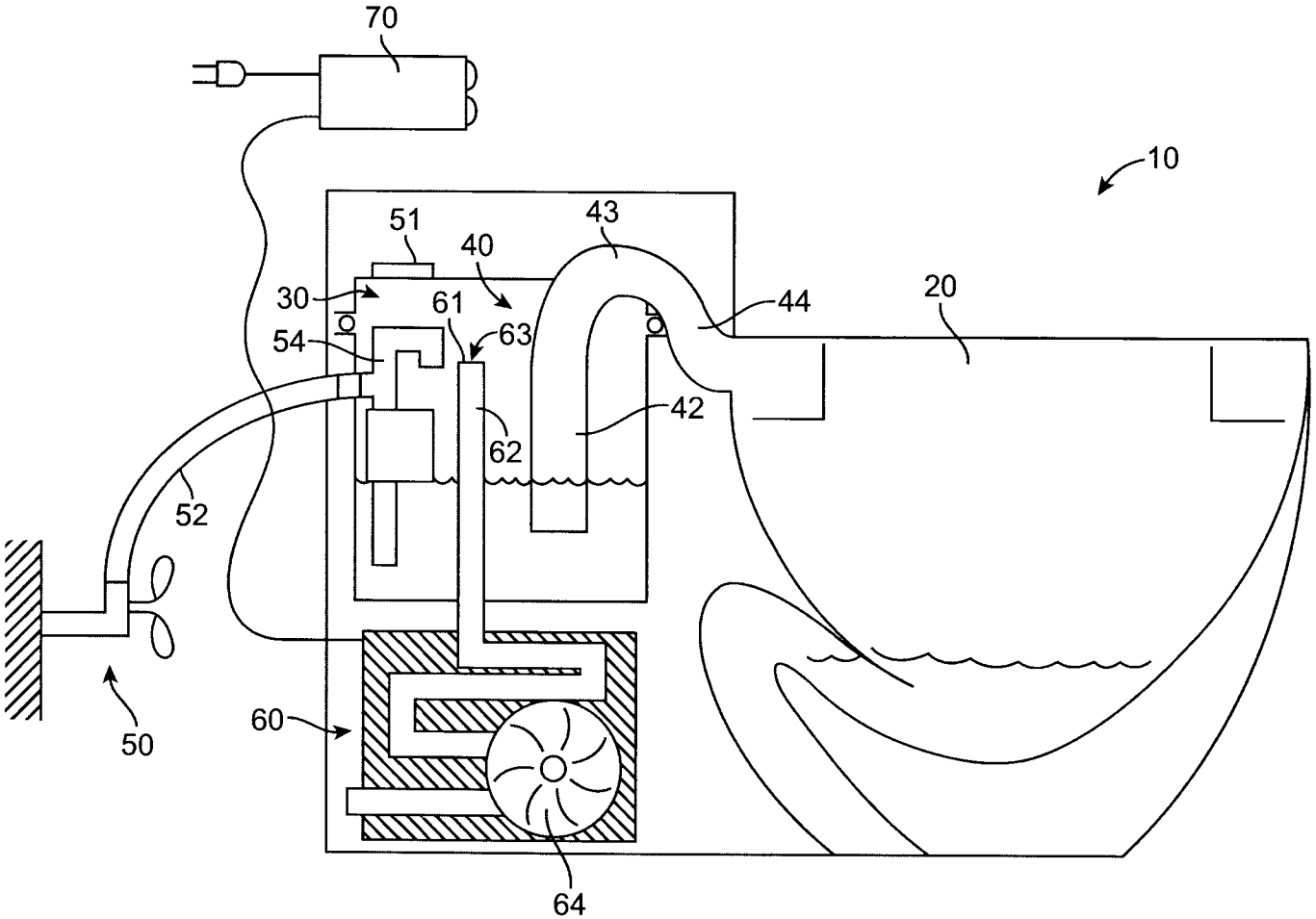
FIG. 1 is a schematic illustration of a first embodiment of the present system.

Referring first to FIG. 1, an air activated toilet flush system 10 is provided. System 10 comprises: a toilet bowl 20; a reservoir (i.e.: water tank) 30; a fluid conduit 40 between reservoir 30 and toilet bowl 20; a system 50 for supplying water into reservoir 30; and a system 60 for supplying air into reservoir 30. System 60 supplies ambient air into reservoir 30. In addition, reservoir 30 preferably has open air communication to the ambient air through system 60 when system 60 is turned off.

Toilet system 10 and bowl 20 may be included on any standard toilet and bowl design system, including both siphon and wash-down toilets. In addition, the present invention may be used in both floor mounted and wall mounted toilets.

Reservoir 30 contains both air and water (sitting at ambient pressure) such that a supply of air into reservoir 30 causes fluid to flow from reservoir 30 through fluid conduit 40 and into toilet bowl 20. System 10 is thus an air activated flushing system since an injection of air into reservoir 30 by air supply system 60 causes the air in the top of reservoir 30 to become pressurized which will in turn push some of the fluid in reservoir 30 up through fluid conduit 40 and into toilet bowl 20. As can be seen, the flush in the present invention is not triggered by gravity acting on water released from an elevated tank above the toilet bowl. Instead, air flow is used to trigger the flush. Specifically, the injection of air into reservoir 30 causes air pressure in reservoir 30 to increase, thereby forcing fluid out of reservoir 30 through fluid conduit 40 and into toilet bowl 20.

As can also be seen, reservoir 30 contains a mixture of air and fluid at ambient pressure, and the fluid level in reservoir 30 is an important feature of the design, as follows. As illustrated, water reservoir 30 contains a predetermined volume of water with a small air space above it. Air supply system 60 preferably has an air outlet 61 into reservoir 30 that is positioned above inlet 42 of fluid conduit 40. Optionally, the air outlet 61 into reservoir 30 comprises as air tube 62 that may be positioned to extend upwardly through fluid in reservoir 30 with its top opening 63 being disposed above the fluid level in reservoir 30, as shown. As can be seen, water reservoir 30 has a closed upper end above the air space.

As stated above, water reservoir 30 need not be positioned above and behind the toilet. The location of reservoir 30 is instead flexible, as it may be positioned above the toilet bowl, to the side of the toilet bowl, be concealed in a wall or cabinet nearby, or even be positioned under the floor. Since the toilet bowl and the fluid reservoir need not be positioned right next to (or in front of) one another, the present invention can therefore be located in small bathrooms and/or require a small bathroom stall when mounted right up against a wall. Water reservoir tank 30 can be made of acrylic, or any other suitable material that creates a suitable air seal, including but not limited to, polyethylene (HDPE), polypropelene (PP) and ABS. Alternatively, reservoir 30 could also be made of ceramics, metals or other materials. Furthermore, reservoir 30 can be made of various shapes to take advantage of any "dead space" in the toilet. For instance, most toilets feature a cosmetic exterior wall (in addition to the bowl and trapway). Therefore, there is an irregularly shaped space commonly found between the bowl and the trapway. All, or at least a portion of reservoir 30 can optionally be located in this "dead space", without increasing the overall space of the toilet.

Water supply 50 may simply comprise an external water source 52 (such as a main water line) fluidly connected to a standard fill valve 54 positioned within reservoir 30. Fill valve 54 may be a standard mechanical fill valve, including existing float-controlled refill valves, and standard vertical or horizontal fill valves. A removable hatch or door 51 can be provided on reservoir 30 for easy replacement of the fill valve 54.

Fluid conduit 40 preferably comprises a tube or passageway with a riser 42 positioned in reservoir 30 and a downward spillway 44 running into toilet bowl 20. In preferred embodiments, fluid conduit 40 has a mid-section 43 positioned higher than the rim wash into the toilet bowl. An advantage of this design is that it prevents any back flow from toilet bowl 20 into reservoir 30 (in the event of a blockage in the bottom of the toilet bowl during a flush).

In various embodiments, air supply 60 comprises an air blower 64. Blower 64 may be a centrifugal blower, but it is to be understood that the present invention is not limited to any particular embodiment of air supply. The blower, due to its open design during non-operation, preferably serves as both the ambient connection for the reservoir and air inlet. For example, axial, centrifugal, multi-stage centrifugal, belt-diven centrifugal, roots blower, linear air pump or regenerative fans can be used. In addition, an air pump may be used. Also contemplated within the scope of the invention are compressed air chambers with mechanical or electrical valves that gate an air outlet. Any source of pressurized air may be used, including a pressurized air inlet pipe connected to a source of pressurized air mounted remotely from the toilet.

In preferred aspects, blower 64 may be made with a damping material positioned around its housing shell and/or its mounting to reduce noise (and/or vibration). The air blower enclosure can be made of ceramic and foam or other suitable noise reduction medium (to reduce noise and vibration). Damping material may also be positioned around the inlet and outlet of blower 64 for noise/vibration reduction. For example, one preferred embodiment comprises a tortuous path for the inlet and outlet that is created by damping material to capture sound waves. In various alternate embodiments, this tortuous path may be wrapped around the air blower, thus sharing some of its noise damping material and reducing size. Alternatively, the tortuous path is eliminated and air is simply blown through an open cell material for its noise damping. Air supply 60 may optionally be powered by electrical power (for example: either through a plug in wall outlet connection or through batteries). The location of air blower 64 is flexible, as it may be positioned above the toilet bowl, to the side of the toilet bowl, be concealed in a wall or cabinet nearby, or even be positioned under the floor. As a result, the present invention can be located in small bathrooms and/or require a small bathroom stall.

In alternate designs, both reservoir 30 and blower 64 can be located within the same cabinet or housing. For example, both may be located in a housing that is part of the toilet itself. As such, both reservoir 30 and blower 64 can be located within a porcelain housing above and behind the toilet bowl. In this embodiment, the present invention may even resemble a standard commercially available toilet.

Any type of air pump or blower may be used in air supply system 60, including a pump powered by a rechargeable battery, by an electrical outlet, or both. (For example, with a battery providing back-up in a power failure. Preferably, the air pump is powered by a battery, or a battery is used for backup in the event of a power outage. Moreover, a rechargeable battery can be used such that the battery is simply recharged using a standard AC outlet. Additionally, sound insulation, such as foam rubber or other noise damping material, may be included in the inside of the bowl to muffle the sound of the air pump. Preferably, a recharge circuit can be built into toilet, or the battery can be removable.

System 10 also comprises a user-activated electronic microprocessor flush actuator 70. Preferably, flush actuator 70 provides electronic microprocessor control of a variety of flush profile inputs. For example, flush actuator 70 may have a setting for a "full" flush and a setting for a "half" flush. Other options including a "¾ flush" or a "slow and quiet night flush". It is to be understood that the present invention is not limited to any particular flush profile or profiles. Rather, since flush actuator 70 can be set to control the exact timing and amount of water (for example, if sensors are utilized on the reservoir or bowl) supplied by system 60, then any number of different flush profiles may be designed or used. As can also be seen, flush actuator 70 need not be positioned next to (or in physical contact with) reservoir 30. Instead, the flush actuator may be mounted anywhere on the wall within reach from the toilet. In various embodiments, communication between flush actuator 70 and blower 62 can be by electric wiring or it may be done wirelessly. Flush actuator 70 may itself be powered by a standard wall outlet, or through battery power. In addition, since power is delivered to both blower 62 and flush actuator 70, optional auxiliary power interfaces can also be located on the toilet for other bathroom appliances, lighting or for autoflush sensors. It is to be understood, however, that flush actuator 70 need not be a microprocessor. For example, the present invention also encompasses a simple timer or RC circuit flush actuator.

To flush the toilet, flush actuator 70 is pushed or switched such that the source of pressurized air is actuated so that pressurized air is allowed to flow into the air space above the water in water reservoir 30. Although the outlet 61 of source of pressurized air is preferably situated above the surface of the water in the water reservoir in the pre-flush state, it may also be submerged without departing from the scope of the invention. Where the source of pressurized air is a local air pump 64, a flush may be accomplished by simply activating the air pump. Where the source of pressurized air is a pressurized air inlet line (for example connected to a remote air compressor), this may be accomplished by opening a valve that allows air to flow into the water reservoir and close the free passage of air between the reservoir and ambient air. Fluid conduit 40 has an open lower end submerged beneath the surface of the water when the toilet is in a pre-flush state. As air flows into the air space above the water in reservoir 30, the air space becomes pressurized relative to the atmosphere. However, the upper end of fluid conduit 40 is open to the atmosphere via spillway 44 into toilet bowl 20. Thus, the air pressure in reservoir 30 becomes greater than the air pressure in fluid conduit 40, and the water in reservoir 30 is thus forced up in fluid conduit 40 and down into spillway 44 and into toilet bowl 20, thus initiating a toilet flush.

When the level of the water in reservoir 30 lowers during a flush, float-controlled refill valve 54 opens and water starts flowing into reservoir 30. This continues until the water level reaches the predetermined pre-flush state, at which point the float-controlled refill valve turns off and the flush cycle is complete.

The present invention is also advantageous with respect to noise reduction strategies for the use of air. For example, bowl 20 may be made together with a noise damping material (for example, by spraying a noise damping material to its underside). As stated above, blower 64 could be a single or double stage blower, but it could alternately be a low vibration belt-drive centrifugal blower. In addition, noise and vibration can also be reduced by software, as follows. First, the motor in blower 64 can be braked during the wind down of the blower to reduce the amount of perceived noise. Second, the motor in blower 64 can have a slow start up to reduce the amount of perceived noise. Third, the blower 64 can optionally be run at a low level during user operation. Fourth, blower 64 may be positioned in a recessed area within reservoir 30 such that the water in reservoir 30 also assists in the damping. Other noise reduction strategies include "closed loop electronic noise cancellation" in which a microphone is used to sense blower noise frequency and a noise is emitted from the speakers at a frequency to cancel or block the blower noise. In yet another embodiment, noise cancellation can be achieved by using wave chambers or other reflective sound chambers that are designed to reflect certain frequencies of sound back into the flow of air, thus cancelling it. They accomplish this through the geometric design of the chamber to "bounce" the right kind of sound back. This is commonly done in automotive muffler applications. Yet another noise abatement strategy is for air blower 64 to have a spiral air conduit for its inlet and another spiral air conduit for its outlet with the conduits concentrically positioned around the blower to make the whole unit compact.

The present invention also has advantages in how the duration and profile of the flush is easily controlled and even customized. Although the duration of the flush may be controlled with a float valve that cuts off the flow of pressurized air when the water in the reservoir 30 reaches a sufficiently low level, the flow of pressurized air may be controlled electronically with a timing circuit in flush actuator 70. For example, a circuit may be programmed to activate blower 64 for one amount of a time for a full flush, and a lesser amount of time for a small flush. The amounts of times blower 64 is activated (or, in the case of a pressurized air inlet line, that the inlet valve is opened) are not critical and depend on the pressure and flow rate of the air being supplied. Thus, it is also possible to control or customize the flush profile. For example, the control circuit may be programmed to initially provide a relatively high air pressure in the reservoir to initiate the flush, and then to slowly decrease in pressure as the flush completes.

The control circuit may be (but is not necessarily) a programmable microcontroller. The control circuit may control the source of pressurized air itself, or may control a valve that regulates pressurized air flow into the water reservoir. Such a control circuit could be coupled to a user interface mounted on the exterior of the toilet or on the wall adjacent the toilet. The user interface allows the user to control and customize the flush settings. For example, the user may wish to have a slower and quieter flush at night to avoid waking others in the home. Alternatively, the user may not be concerned with the noise generated and could select a faster and more powerful flush. A longer "cleaning flush" may also be pre-set as an option as well. The user interface 70 may be as simple as one or two buttons, or as complex as a keypad with a small screen showing information about selected and stored flush profiles. The user interface may also have a communications port, such as a universal serial bus port, that allows the user to upload flush profiles onto the toilet from a computer or from a thumb drive. All of these features are of course optional. The user interface could provide digital feedback of operation. An optional calibration system can be included as well into user interface 70. Such a calibration system could be used during the initial installation to ensure that the flush water volumes are within ranges appropriate for the particular municipal, state or national building codes. Furthermore, the flush calibration system can optionally be "auto-calibrating" such that the system would re-calibrate after a period of time. This may be desirable as the motor wears or the system otherwise changes over time.

Figure 2B:
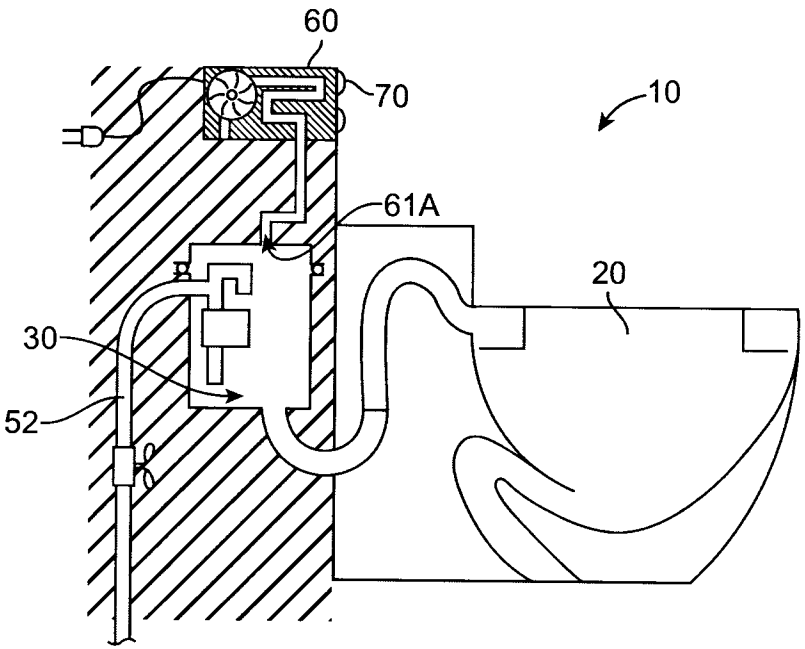
FIGS. 2A and 2B show schematic illustrations of a second embodiment of the present system.
Figure 2A:
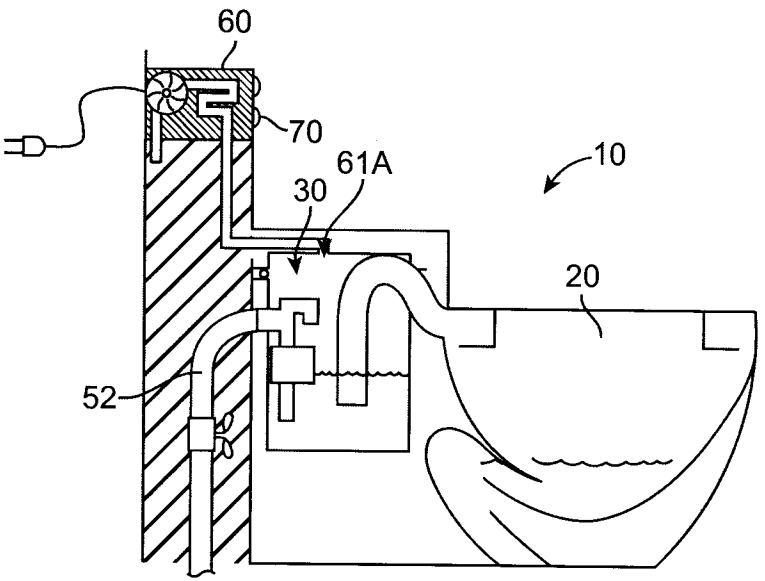

FIGS. 2A and 2B show an alternate embodiment wherein the air inlet 61A (from air supply 60A) into reservoir 30 is instead disposed at the top of reservoir 30. In this embodiment, an internal air tube (62 in FIG. 1) is not required. In all other aspects, the system of FIG. 2 operates in basically the same manner as the system of FIG. 1. In FIG. 2A, reservoir 30 is mounted in the toilet. In contrast, in FIG. 2B, reservoir 30 is instead mounted directly within the wall behind the toilet.

Figure 3:
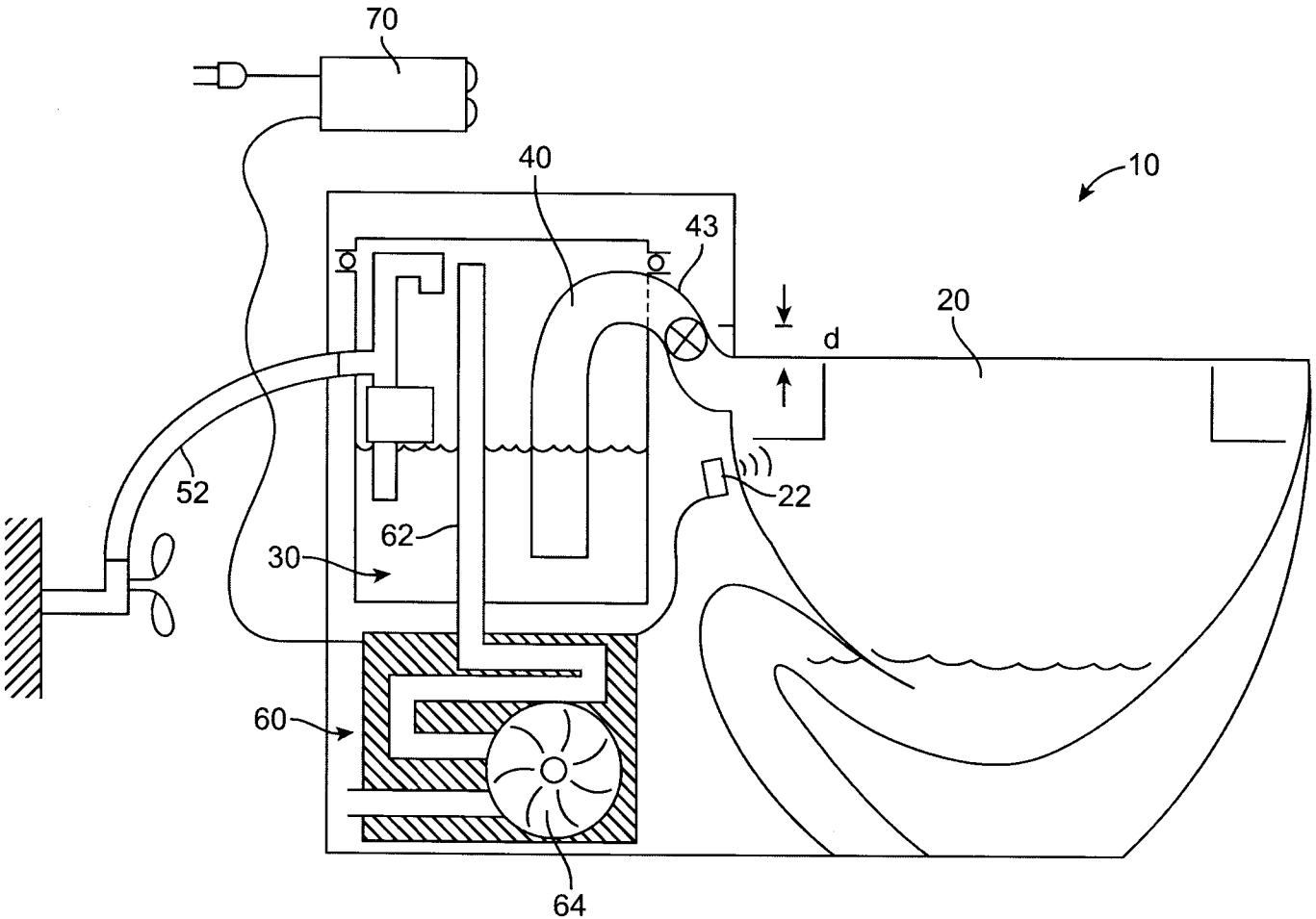
FIG. 3 is a schematic illustration of a third embodiment of the present system.

FIG. 3 shows a third embodiment of system 10 in which several additional optional features are disclosed, as follows. First, the mid-section 43 of conduit 40 is disposed at a nominal distance greater than zero above the top of toilet bowl 20. This feature prevents any overflow of toilet bowl 20 (caused from a stoppage in the bottom of the toilet bowl) from passing back up through spillway 44 and passing into reservoir 30. Alternatively, or in addition, an optional one way check valve 43 can be installed in fluid conduit 40 to prevent backwards flow from bowl 20 into reservoir 30. Another optional feature of the invention is a water level sensor 22 in bowl 20. Sensor 22 operates to detect an overflow of water in bowl 20. Should the water level in the bowl reach the height of sensor 22, sensor 22 will then signal air supply 60 to shut off the flush (so as to prevent bowl 20 from overfilling). Furthermore, the outlet 61 of the air supply is positioned above the maximum water height in reservoir 30. Preferably, fill valve 54 only permits a maximum fluid level in reservoir 30 that is just below mid-portion 43 of fluid conduit 40. This feature ensures that fluid in reservoir 30 cannot drain into bowl 20 in the absence of a flush. Other optional sensors (not shown) could also be placed within reservoir 30 to determine the fluid level within the reservoir (to shut off flow into the reservoir should the water level therein become too high or to control flush volumes more accurately). In addition, it is also possible to monitor the float position on fill valve 54 to obtain a more detailed feedback of the water level in reservoir 30. In addition, the fluid inlet to reservoir 30 is preferably positioned above the water level (as established by riser/rim heights). This prevents contaminated reservoir water from getting into the fresh water line water supply.

Figure 4:
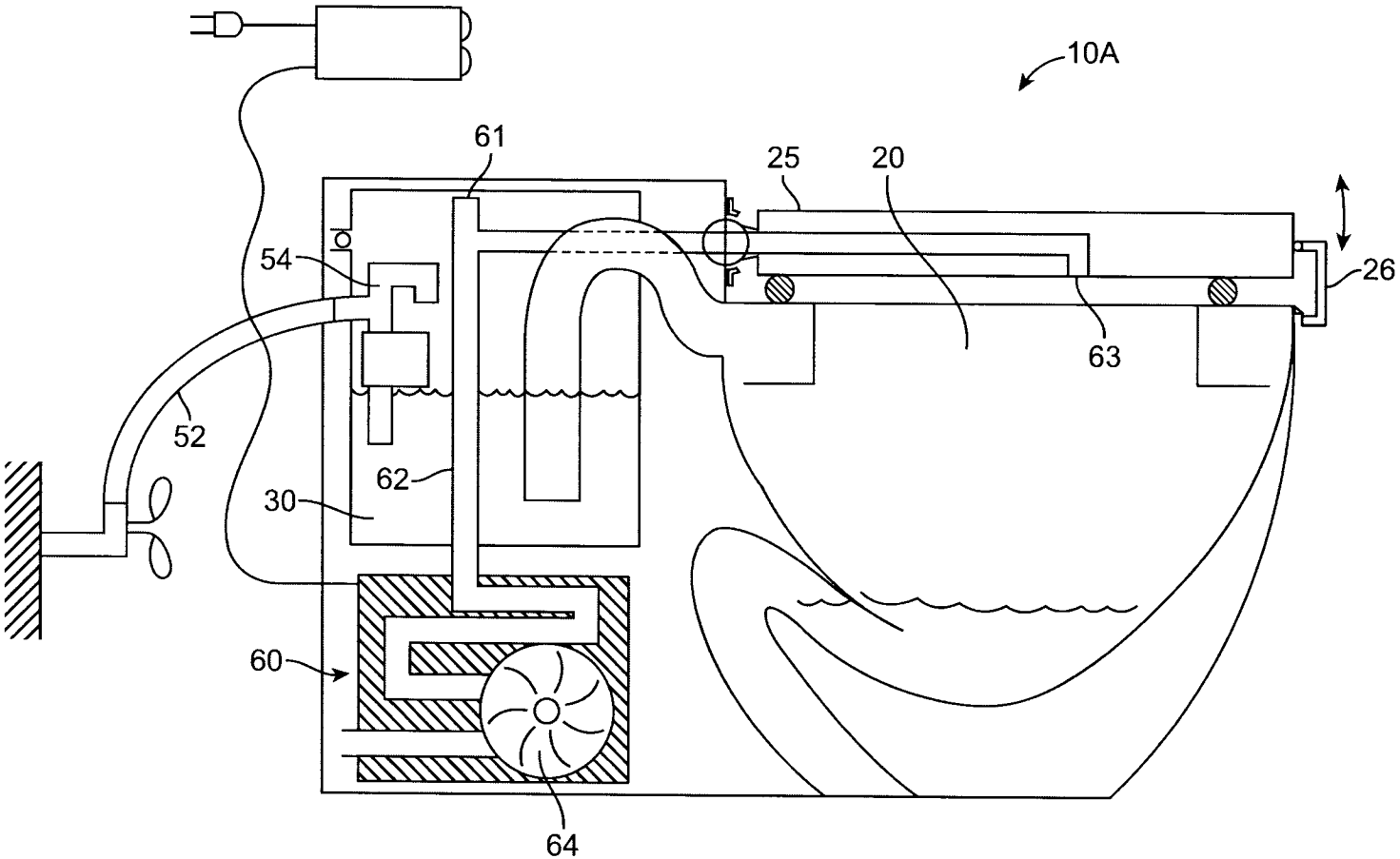
FIG. 4 is a schematic illustration of a fourth embodiment of the present system.

FIG. 4 illustrates an alternate embodiment of the invention in which air is injected directly into the toilet bowl (as opposed to a fluid/air reservoir) to initiate the flushing action. In this embodiment, system 10A includes a bowl 20, reservoir 30, fluid conduit 40, water supply 50 and air supply 60, operating similar to system 10 described above. However, system 10 further comprises a lid 25 that has an air tight seal over bowl 20. An optional latch 26 may also be provided for tightly closing lid 25. In this embodiment, air is injected directly into bowl 20. This air injection increases air pressure in the bowl and thus displaces the water in the bowl such that flushing starts. As can be seen, the air entering through air tube 62 can be directed either directly into bowl 20 (through tube 63), or into reservoir 30 (through opening 61), or both. Valves and/or control systems may be provided to direct air into the desired pathway(s). Thus, air flow from blower 64 can be sent into reservoir 30 (to initiate a flush), or bowl 20 (to initiate a flush), or both.

Figure 5:
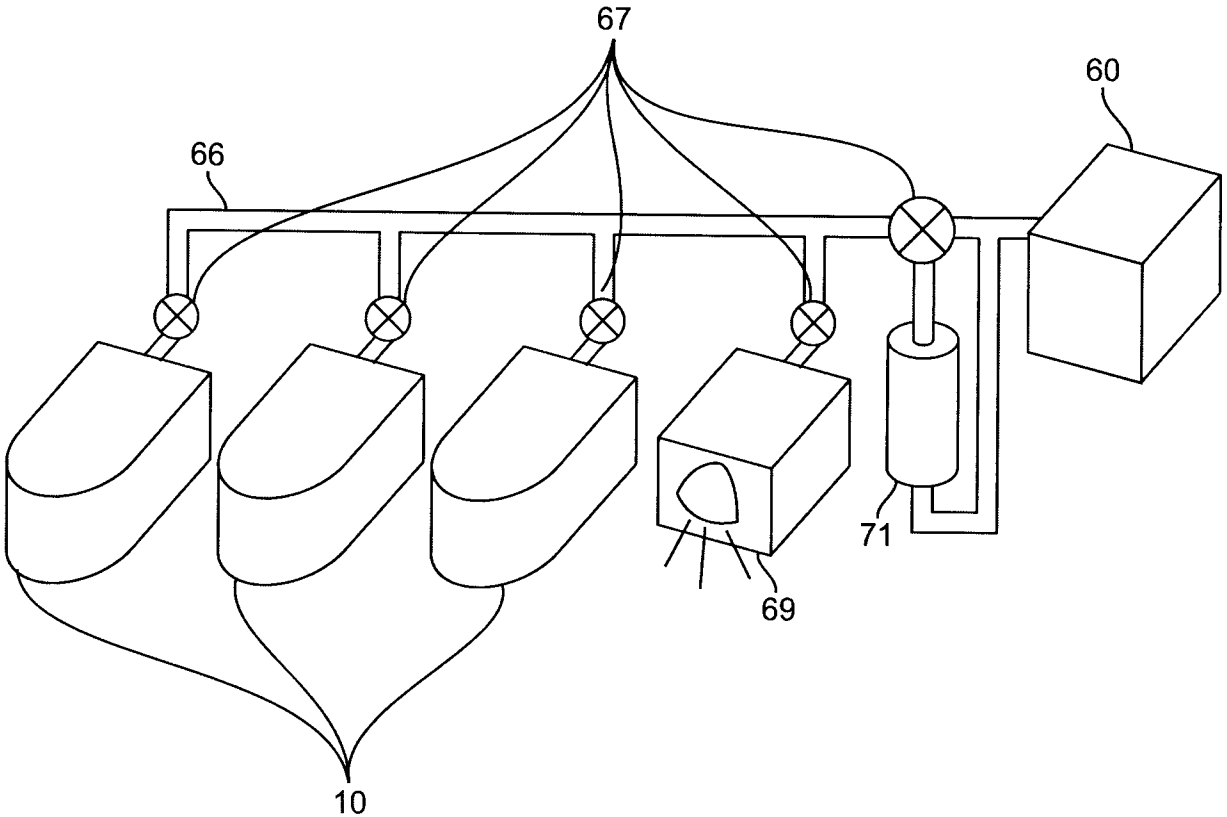
FIG. 5 is an air pressure manifold system for a plurality of toilets.

FIG. 5 illustrates another embodiment of the invention in which a plurality of toilet systems 10 share a single air supply 60 by way of a manifold 66 (with control valves 67). This system has the advantage of using only one central air supply, and is thus well suited to be used in the commercial marketplace. In addition this same air supply may be used to power a bathroom fan or hand dryer 69 cab be added. An optional air filter 71 is also illustrated. An outlet for a central vacuum system could also be used in conjunction with a central vacuuming system Various modifications and alterations of the inventions will become apparent to those skilled in the art without departing from the spirit and scope of the inventions, which are defined by the accompanying claims. For example, the type of flush actuator used may vary widely, and may be mounted in a wide variety of locations including on top of the tank, on the side of the tank, a foot activated actuator on the floor, or a hand activated actuator mounted on the wall behind the toilet and substantially above the toilet. The accompanying claims should be constructed with these principles in mind.

Any element in a claim that does not explicitly state "means for" performing a specified function or "step for" performing a specified function is not to be interpreted as a "means" or "step" clause as specified in 35 U.S.C. §112, ¶ 6.

What is claimed is:

1. An air activated toilet flush system, comprising:

a toilet bowl;

a reservoir;

a fluid conduit between the reservoir and the toilet bowl;

a system for supplying water into the reservoir, the system comprising a fill valve activated by the height of water in the reservoir; and a system for supplying ambient air into the reservoir, wherein a supply of ambient air into the reservoir causes fluid to flow from the reservoir through the fluid conduit and into the toilet bowl, and wherein the system for supplying ambient air into the reservoir can be operated in different flush profiles, and (i) wherein the system for supplying ambient air into the reservoir comprises an open air path therethrough permitting free passage of air between the reservoir and the ambient environment when the system for supplying ambient air is turned off, and (ii) wherein the system for supplying ambient air overcomes the free passage of air in the open air path between the reservoir and the ambient environment and pushes ambient air into the reservoir when the system for supplying ambient air is turned on, and (iii) wherein ambient air pushed into the reservoir can only exit the reservoir back through the system for supplying ambient air into the reservoir such that the reservoir has only one combined air inlet/outlet when the water level in the reservoir is above the bottom end of the fluid conduit; and wherein the water level in the reservoir is higher than the water level in the toilet bowl.

2. The system of claim 1, wherein the reservoir contains air and fluid, and wherein the supply of air into the reservoir causes air pressure in the reservoir to increase, thereby forcing fluid out of the reservoir through the fluid conduit and into the toilet bowl.

3. The system of claim 1, wherein the system for supplying ambient air to the reservoir supplies ambient air above an inlet of the fluid conduit into the toilet bowl.

4. The system of claim 1, wherein the system for supplying water to the reservoir comprises an external water source connected to a fill valve positioned within the reservoir.

5. The system of claim 1, wherein the fluid conduit comprises a riser in the reservoir and a spillway into the toilet bowl.

6. The system of claim 1, wherein the system for supplying ambient air to the reservoir comprises:

an air blower that is both the air supply and ambient connection for reservoir.

7. The system of claim 6, wherein the air blower is encapsulated in a noise dampening material.

8. The system of claim 1, wherein the system for supplying ambient air to the reservoir is powered by electrical power.

9. The system of claim 1, wherein the fluid conduit comprises a tube having a downward spillway into the toilet bowl.

10. The system of claim 9, wherein the outlet of the fill valve is positioned above the riser or fluid conduit mid-section.

11. The system of claim 9, wherein the fluid conduit has a mid-section positioned higher than the rim of the toilet bowl.

12. The system of claim 1, wherein the system for supplying ambient air to the reservoir comprises an air tube.

13. The system of claim 12, wherein the air tube is positioned to extend upwardly through fluid in the reservoir with an opening of the air tube disposed above fluid in the reservoir.

14. The system of claim 1, wherein the system for supplying ambient air into the reservoir comprises a user-activated flush actuator.

15. The system of claim 14, wherein the user-activated flush actuator comprises a plurality of flush profile inputs.

16. The system of claim 14, wherein the user-activated flush actuator comprises electronic control of flush profile.

17. The system of claim 1, wherein the system for supplying ambient air into the reservoir is electrically powered.

18. The system of claim 17, wherein the system for supplying ambient air into the reservoir is battery powered.

19. A toilet, comprising:

a toilet bowl;

a tank attached to the toilet bowl;

a water reservoir within the tank and containing a predetermined volume of water;

a riser conduit having an upper end above the surface of the predetermined volume of water and a lower end extending below the surface of the predetermined volume of water;

a spillway providing a path for fluid flow between the upper end of the riser conduit and the toilet bowl;

an air inlet conduit into the water reservoir to supply ambient air into the water reservoir;

a source of pressurized ambient air connected to the air inlet conduit; and (i) wherein the source of pressurized ambient air comprises an open air path permitting free passage of air between the reservoir and the ambient environment when the source of pressurized ambient air is turned off, and (ii) wherein the source of pressurized ambient air overcomes the free passage of air in the open air path between the reservoir and the ambient environment and pushes ambient air into the reservoir when the source of pressurized ambient air is turned on, (iii) wherein ambient air pushed into the reservoir can only exit the reservoir back through the source of pressurized ambient air connected to the air inlet conduit such that the reservoir has only one combined air inlet/outlet when the water level in the reservoir is above the bottom end of the fluid conduit; and (iv) wherein the source of pressurized ambient air into the reservoir can be operated in different flush profiles; and a flush actuator associated with the source of pressurized ambient air, wherein when the flush actuator is activated, pressurized ambient air flows through the outlet of the air conduit into the water reservoir above the surface of the predetermined volume of water, thereby forcing at least a portion of the predetermined volume of water up the riser conduit, through the spillway and into the toilet bowl; and wherein the water level in the reservoir is higher than the water level in the toilet bowl.

20. The toilet of claim 19, further comprising a system for supplying water into the tank including an external water source connected to a fill valve positioned within the reservoir.

21. The toilet of claim 19, wherein the source of pressurized ambient air comprises an air blower.

22. The toilet of claim 19, wherein the riser conduit comprises a tube having a mid-section positioned higher than the rim of the toilet bowl.

23. The toilet of claim 19, wherein the flush actuator comprises a plurality of flush profile inputs.

24. The toilet of claim 19, wherein the flush actuator comprises electronic control of flush profile.

* * * * *